US005324486A

United States Patent [19]

Russo

[11] Patent Number: 5,324,486

[45] Date of Patent: Jun. 28, 1994

[54] HYDROCARBON CRACKING APPARATUS

[76] Inventor: Gaetano Russo, 45 Norville Street, East Bentleigh, Victoria 3165, Australia

[21] Appl. No.: 827,735

[22] Filed: Jan. 29, 1992

Related U.S. Application Data

[60] Division of Ser. No. 473,116, Jan. 31, 1990, Pat. No. 5,092,981, which is a continuation of Ser. No. 274,623, Nov. 22, 1988, abandoned, which is a continuation of Ser. No. 136,925, Oct. 19, 1987, abandoned.

[30] Foreign Application Priority Data

Feb. 2, 1986 [AU] Australia ..... PH4686

[51] Int. Cl.[5] ..... F28D 21/00; C09D 1/00; C07C 4/02; C10G 9/12

[52] U.S. Cl. ..... 422/207; 422/151; 422/156; 422/208; 208/48 Q; 48/127.9; 585/613

[58] Field of Search ..... 422/151, 156, 207, 208; 208/48 Q, 95, 106, 130; 261/DIG. 48, DIG. 54, DIG. 76, DIG. 78; 585/613, 648, 800, 903, 910, 950; 48/127.9

[56] References Cited

U.S. PATENT DOCUMENTS

| | | | |
|---|---|---|---|
| 2,805,131 | 9/1957 | McIntire | 422/151 |
| 2,813,138 | 11/1957 | MacQueen | 422/207 |
| 2,851,337 | 9/1958 | Heller | 422/151 |
| 3,103,485 | 9/1963 | Cahn | 261/DIG. 54 |
| 3,545,886 | 12/1970 | Chalom | 261/DIG. 78 |
| 3,663,645 | 5/1972 | Dorn et al. | 261/DIG. 54 |
| 4,288,408 | 9/1981 | Guth et al. | 422/207 |
| 4,379,679 | 4/1983 | Guile | 417/54 |
| 4,662,993 | 5/1987 | Schaefer | 162/242 |

FOREIGN PATENT DOCUMENTS

| | | | |
|---|---|---|---|
| 1071673 | 12/1959 | Fed. Rep. of Germany | 261/DIG. 54 |

*Primary Examiner*—Robert J. Warden
*Assistant Examiner*—Christopher Y. Kim
*Attorney, Agent, or Firm*—Learman & McCulloch

[57] ABSTRACT

Apparatus and process for compressing and quenching a cracked gas stream from a hydrocarbon cracking furnace including the step of feeding furnace output directly into an ejector in the effluent line, the ejector acting to quench and compress the effluent by injection of pressurized motive fluid into the ejector thereby rapidly mixing the motive fluid with the effluent for quick quenching and compression to prevent coke build-up and allow efficient heat exchanger and low pressure furnace operation.

7 Claims, 3 Drawing Sheets

HYDROCARBON CRACKING APPARATUS

This is a division of copending application Ser. No. 473,116 filed Jan. 31, 1990, now U.S. Pat. No. 5,092,981, which is a continuation of Ser. No. 136,925, filed Oct. 19, 1987, now abandoned, which is a continuation of Ser. No. 274,623 filed Nov. 22, 1988, now abandoned.

Most of the ethylene produced in the world is made via the steam cracking process. This process usually consists of a feedstock (such as ethane, propane, butane, naphtha or gasoil) which is heated rapidly to high temperatures within tubular coils where the cracking reactions occur. The steam cracking furnace provides heat for the cracking reactions by burning fuel and transferring heat to the tubular coils which lie within the furnace firebox.

Steam is normally added to the feedstock in the coils prior to the radiant section of the furnace to provide the following benefits:

a) Reduce the hydrocarbon partial pressure within the coils to improve product yields.

b) Reduce coking rate within the coils.

c) Increase coil life by reducing carburization rate.

The steam cracking furnace is normally the key equipment item affecting profitability within a petrochemical plant. As such, much work has been done over the last 20 years to improve furnace performance; particularly feedstock flexibility, product yields and energy efficiency.

Product yields have been improved in recent years by reducing the residence time of the feedstock and products within the radiant section of the furnace and in the furnace coil outlet piping upstream of the quench points or Transfer Line Exchanger (T.L.E.)—see U.S. Pat. No. 3,923,921. At reduced residence times, coil average and coil outlet temperatures have increased to maintain feedstock conversion or cracking severity. At higher coil outlet temperatures, the need to very rapidly quench the cracking reactions becomes more important since this unfired residence time can result in rapid over-conversion of the feed and/or increased tar and coke formation. Current practice in the petrochemical industry is to locate quench points or T.L.E.'s relatively close to the furnace coil outlet and the hot furnace effluent is cooled/quenched to a point where most cracking reactions stop within a period of 30 to 50 milliseconds after exiting the furnace.

When the hot furnace effluent leaves the furnace, it can be quenched with an oil or water spray—see U.S. Pat. No. 4,599,478 and/or cooled using a T.L.E. Normal practice is that an oil spray is used when the cracking feedstock is gasoil or heavier and a T.L.E. is used for lighter feedstocks such as naphtha, L.P.G. and ethane. Using a T.L.E. is more energy efficient than oil quench since heat is recovered from the furnace effluent at a higher temperature level. Oil quench is normally employed for heavy feedstocks because the large tar and coke yields from them rapidly foul downstream equipment such as T.L.E.'s—see, for example, U.S. Pat. No. 4,444,697.

There are many T.L.E. designs and sometimes, in non-gasoil service, two T.L.E.'s are placed in series to extract the maximum amount of high level heat from the process stream. The first T.L.E. in a series is called the primary T.L.E. and the main functions of this exchanger are to very rapidly cool the furnace effluent and generate high pressure steam. The next T.L.E. is called the secondary T.L.E. and its main functions are to cool the furnace effluent to as low a temperature as possible consistent with efficient primary fractionator or quench tower performance and generate medium to low pressure steam.

The drive towards higher energy efficiency within petrochemical plants in recent years has led to the development of T.L.E.'s that will cope with some gasoil feedstocks. These T.L.E.'s operate at higher temperatures than those in non-gasoil service and generate higher pressure steam to minimise the fouling caused by tar and coke deposition.

The deposition of coke within the cracking coil and in the quench points or T.L.E.'s is a major operating problem with steam cracking furnaces. The coke build-up finally limits furnace throughput (via a coil temperature constraint or unacceptably high pressure drops). The coke is removed by burning it off the metal surfaces (in an operation called decoking).

A major problem with existing cracking furnaces is the high coil outlet pressure that results from the pressure drop between the furnace coil outlet and the inlet of the process gas compressor, as the gas flows through piping, T.L.E.'s, fractionation and/or quench towers; and the safety requirement to maintain a process gas compressor suction pressure above atmospheric. Unfortunately this high pressure adversely affects the efficiency of the cracking reaction in the furnace. It has been recognised that a lowering of the pressure of the gas in the furnace outlet leads to improved product yields because there is a close correlation between the cracking reactions and the outlet gas pressure.

The present invention has as its principal object the provision of a motive fluid ejector, for lowering the furnace coil outlet pressure by compressing the furnace effluent to sufficiently high pressures at the ejector outlet to satisfy the pressure drop requirements of equipment between the ejector and the inlet to a process gas compressor, and at the same time to rapidly quench the temperature of the effluent gas on exiting the cracking furnace. A further objective is to control the quenching temperature so that the cracking reaction is stopped yet provides adequately high temperature effluent for efficient heat exchanger operation and less energy loss.

The present invention provides for relatively low furnace oil outlet pressures in the cracking furnace thus allowing relatively efficient cracking and therefore favourable product yields.

Accordingly, with the present invention, the amount of steam that is added to the coils prior to the radiant section of a steam cracking furnace may be significantly reduced with resultant energy savings.

SUMMARY OF INVENTION

There is provided according to the present invention apparatus for quenching a cracked gas stream from a hydrocarbon cracking furnace having a heating coil in the radiant section of the furnace where feedstock is heated and cracked, and an effluent line downstream of the heating coil at the furnace outlet, wherein a venturi is positioned in said effluent line as close as practicable to said furnace outlet, said venturi receiving furnace effluent and a motive fluid to rapidly mix said fluid with said effluent to quench and compress said effluent and motive fluid mixture.

Conveniently the invention includes the use of two ejectors in series to quench, cool and compress the effluent of a steam cracking furnace. Also it may be desirable to use a process computer to compute various temperatures, flow rates and pressures to optimise the performance of the two ejectors.

The novelty associated with the invention is the combination of: ejector geometry and design, position of ejector on the furnace outlet piping, the use of steam, water or oil as the ejector motive fluid and the use of an ejector as a compressor at the coil outlet to vary coil outlet pressure to achieve the following desirable features:

1) Very low furnace coil outlet pressure (down to 1 p.s.i.g. from a normal of 10–15 p.s.i.g.).
2Low unfired residence time above 1200° F. of the furnace effluent (down to 5 to 10 milliseconds).
3) Reduced hydrocarbon partial pressure during quenching as a result of 1) above and the addition of steam within the ejector.
4) Reduced tar and coke formation and deposition within the pyrolysis coil as a result of 1) above.
5) Suppression of the hydrocarbon dew point of the furnace effluent as a result of 1), 2), 3) and 4) above.
6) Reduced fouling of downstream equipment such as quench points and T.L.E.'s due to 2) above resulting in less tar/coke formation outside the furnace, 4) and 5) above.
7) Improved product yields as a result of 1), 2), 3) and 4) above.
8) Increased run length of the pyrolysis coil due to 4) above.
9) Increased run length of quench points and/or T.L.E.'s due to 6) above.
10) For gasoil feedstocks, improved product separation within the primary fractionator due to additional stripping steam from the ejector steam.
11) Allow higher process gas compressor suction pressure and consequently reduced horsepower/high pressure steam requirement and/or prevent, or remove, bottlenecks in the process gas compressor and primary fractionator or quench tower.
12) In heavy feedstock service, dew point suppression as a result of 5) above may allow installation of a T.L.E. immediately after the ejector with acceptable run lengths.
13) Reduction of steam injection volume into pyrolysis coil thus increasing energy efficiency.

The two main functions of the ejector are to compress the furnace effluent and to rapidly mix and quickly quench the furnace effluent with motive fluid. Thus the effluent has adequate pressure (typically 10–15 p.s.i.g. and is in good condition to enter heat exchangers and fractionators.

The design of the ejector for commercial application can be made standard for incorporation into new furnace quench/T.L.E. systems. For retrofitting existing furnaces, custom designed ejectors may be used taking into account existing furnace/quench/T.L.E. geometry. Some principles that govern the final choice of steam nozzle geometry are as follows:

1) Minimise coking within the ejector.
2) Maximise ejector efficiency.
3) Minimise erosion of the steam nozzle(s) and converging section during normal operation and during decokes.
4) A compromise of 1), 2) and 3) above may be forced by furnace/quench/T.L.E. geometry.

DESCRIPTION OF DRAWINGS

Referring to FIG. 1, hot furnace effluent (1) leaves the furnace and as soon as practicable enters the receiver or ejector 20 which is of venturi construction receiving pressurised motive fluid such as steam, water or oil. The ejector may be welded to the furnace outlet line or flanged and bolted as shown (2). Medium pressure to high pressure steam (8) (100 p.s.i.g. to 600 p.s.i.g.) is piped upstream of the convergent section of the ejector (4). Steam flows through a pipe (3) which is positioned in the centerline of the ejector and then at sonic velocity through a nozzle (9). The high velocity steam entrains furnace effluent and rapid mixing of steam and furnace effluent occurs in the convergent section (4), the mixing or linear throat section (5) and in the divergent section (6). The rapid mixing results in rapid heat transfer and rapid cooling/quenching of the furnace effluent. Pressure recovery occurs in the divergent section (6) and the gas mixture leaves the ejector (7). For high ejector efficiency, a divergent angle (10) of between 4° and 7° is desirable. The convergent/divergent nature of the ejector coupled with the high velocity of the motive steam allows the ejector to act as a compressor on the furnace effluent. Thus the furnace may operate at lower than conventional pressures because of the increase in pressure in the effluent line created by the ejector.

FIG. 2 shows an ejector with a different steam nozzle design. Steam (8) enters a steam chest (3*a*) which supplies steam to a nozzle arrangement (11).

FIGS. 3 and 4 show two options for the nozzle arrangement as viewed from view A. In FIG. 3, between 4 and 50 holes (11*a*) are spread evenly around the circumference of the nozzle.

In FIG. 4, an annular space (11*b*) provides the steam flowpath.

FIGS. 5 and 6 show two extremes of control of the motive fluid flow to the ejector. A simple control scheme is shown in FIG. 5 and consists of a single pressure controller 15 varying fluid flow through control valve 15(*a*) to control furnace coil outlet pressure.

FIG. 6 shows a more sophisticated control scheme in which a process computer 16 has the following inputs:

1) Furnace coil outlet pressure PT.
2) Ejector fluid flow FT.
3) Product yield analysis via a transfer line analyser TLA.
4) Steam balance data.
5) Programmable equipment constraints, steam values and product values.

The computer can evaluate the optimum ejector motive fluid flow in real time based on the cost of ejector motive fluid vs. product yield credits and output to the motive fluid control valve.

A more sophisticated system allows the computer to add motive fluid from different sources or pressure levels depending on the cost/benefit analysis for the various fluids.

Figure 1:
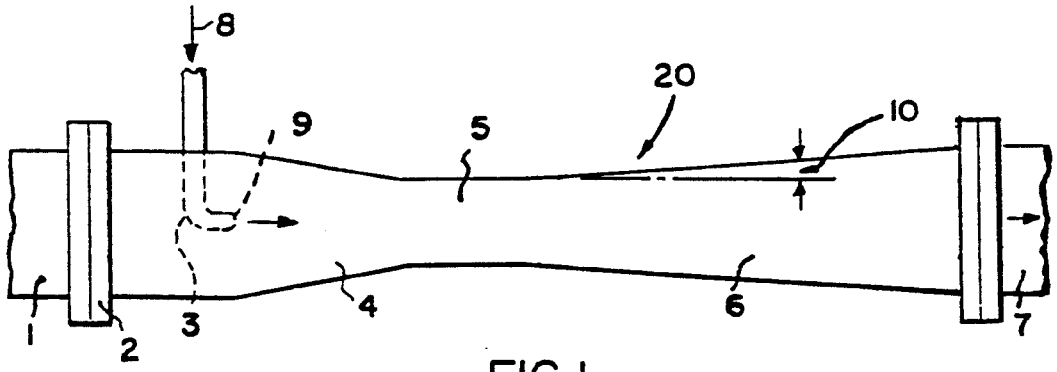
FIGS. 1 and 2 are side views of two embodiments of ejector design.
Figure 2:
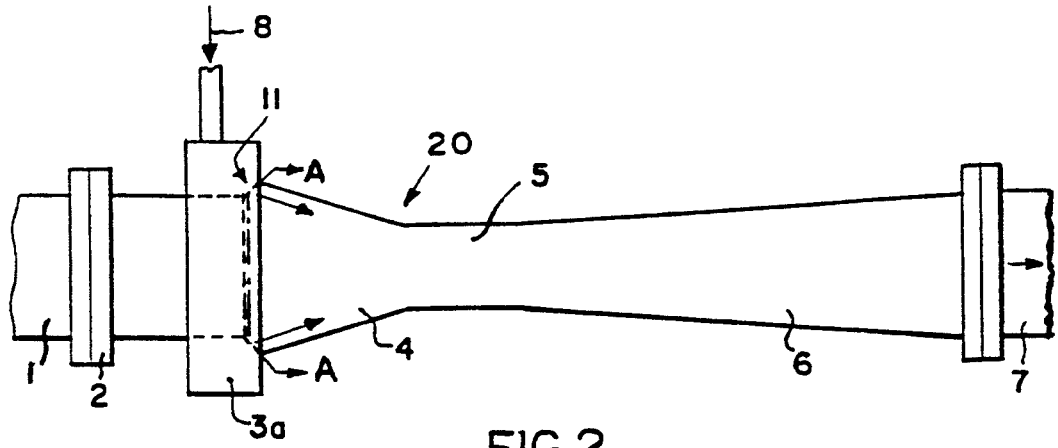
Figure 3:
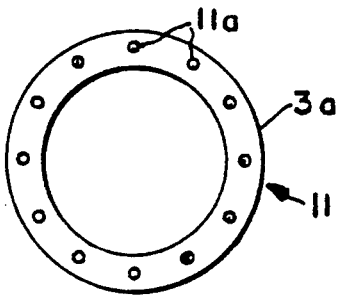
FIGS. 3 and 4 are two embodiments of steam outlet nozzle design.
Figure 4:
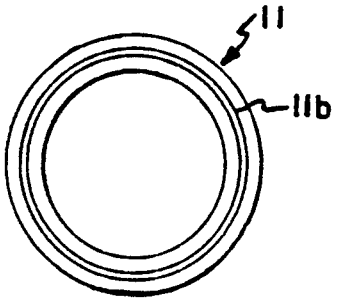
Figure 5:
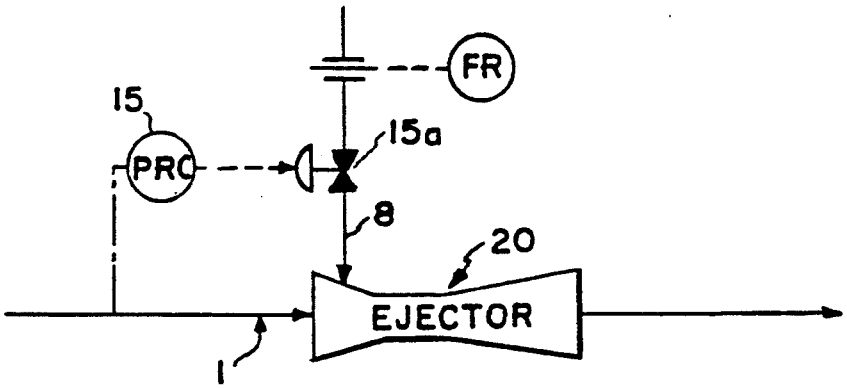
FIG. 5 shows a simple control system for flow of steam to the ejector.
Figure 6:
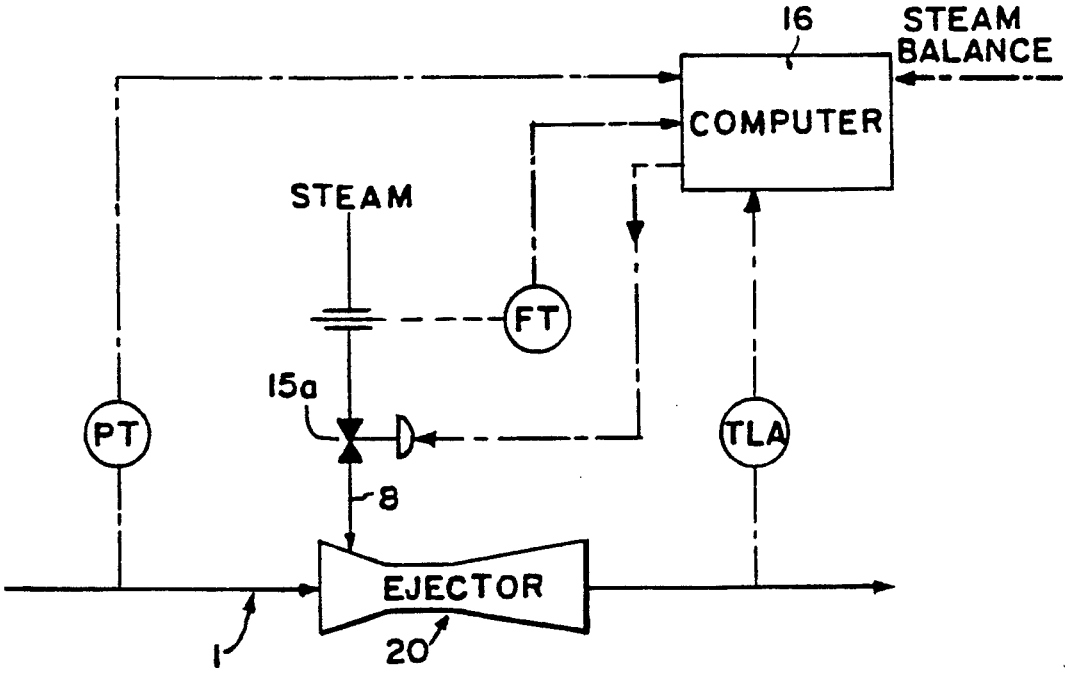
FIG. 6 shows a further embodiment of a steam flow control system.
Figure 7:
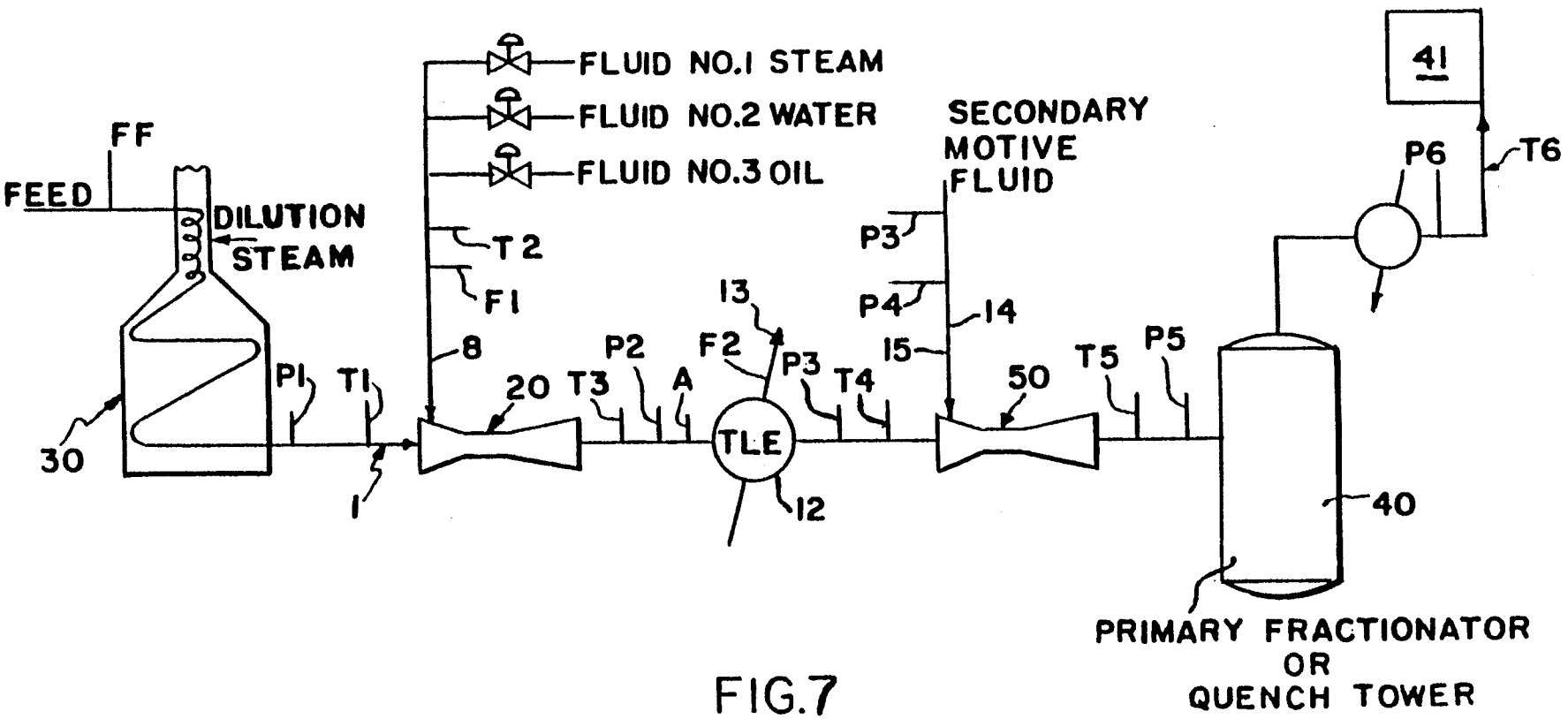
FIG. 7 is a schematic diagram of a further embodiment of an effluent quenching system.

Referring to FIG. 7, the primary ejector is located as close as practicable to the outlet of furnace 30 to minimise unfired residence time of the furnace effluent. The motive fluid 8 introduced into the primary ejector 20 rapidly mixes with and quenches the hot furnace effluent thereby stopping most of the chemical reactions occurring in the effluent stream and increases the pressure of the stream.

On leaving the primary ejector 20, the process stream may be cooled by one or more transfer line exchangers 12 (TLE's) which recover heat from the process stream usually by generation of medium to high pressure steam 13. The decision to use a TLE, or the decision on how many TLE's to use, will depend on furnace feedstock type and individual plant economics.

On leaving the last TLE, the process stream enters a secondary receiver or ejector 50 which cools the process stream to a set temperature for entry into the primary fractionator or quench tower 40. The process gas compressor 41 acts to compress the output of the fractionator or quench tower to pressures of order of 400 p.s.i.g.

Preferably the primary ejector motive fluid 8 will be steam with the option of some water addition for temperature control of the primary ejector outlet temperature. Conveniently the secondary ejector motive fluid will be quench oil 14 if a primary fractionator 40 is used downstream of this ejector or quench water 15 if a quench tower 40 is used.

The main functions of the primary ejector are to:

1. Rapidly mix motive fluid with hot furnace effluent to quench and compress the hot furnace effluent.
2. Reduce unfired residence time above 1200° F. of the furnace effluent.
3. Suppress the hydrocarbon dew point of the furnace effluent.
4. Reduce tar and coke formation within downstream equipment such as TLE's.
5. Improve furnace yields as a result of 1. and 2. above.

The main functions of the secondary ejector are to:

1. Cool the process stream to the correct primary fractionator/quench tower inlet temperature.
2. Reduce the primary ejector motive fluid flow.

The main functions of the combination of primary and secondary ejectors are to:

1. Compress the furnace effluent from furnace coil outlet to primary fractionator/quench tower.
2. Allow optimisation of the flows of primary ejector motive fluid and secondary ejector motive fluid.
3. Allow reduction of furnace coil outlet pressure to improve furnace product yields.

A process computer may be used to control and optimise the primary and secondary ejectors. Referring to FIG. 7, the computer inputs and outputs can include the following:

| Item | Computer Inputs |
|---|---|
| P1 | Furnace coil outlet pressure. |
| T1 | Furnace coil outlet temperature. |
| F1 | Primary ejector motive fluid flow. |
| T2 | Primary ejector motive fluid temperature. |
| T3 | Primary ejector outlet temperature. |
| P2 | Primary ejector outlet pressure. |
| A | Product yield analysis via transfer line analyser. |
| P3 | Secondary ejector inlet pressure. |

-continued

| Item | Computer Inputs |
|---|---|
| T4 | Secondary ejector inlet temperature. |
| F2 | High pressure generated steam flow. |
| F3 | Secondary ejector motive fluid flow. |
| P4 | Secondary ejector motive fluid pressure. |
| T5 | Secondary ejector outlet temperature. |
| P5 | Secondary ejector outlet pressure. |
| P6 | Process gas compressor suction pressure. |
| T6 | Process gas compressor suction temperature. |
| FF | Furnace feed flow rate. |

Other factors include equipment constraints, steam balance data, and feedstock and motive fluid costs; product and byproduct values; furnace/TLE run length, capacity and service factor credits.

The computer outputs may control the following parameters:

(i) Furnace feed flow.
(ii) Selection of primary ejector motive fluid source.
(iii) Secondary ejector motive fluid flow.
(iv) Secondary ejector motive fluid temperature (via motive fluid cooler bypassing).
(v) Process gas compressor suction pressure.

I claim:

1. The combination of a hydrocarbon cracking furnace and a furnace attachment for quenching pressurized cracked gas effluent all of which is discharged at a velocity from said cracking furnace through an outlet at an elevated temperature, said attachment comprising effluent receiver means external of said furnace; means coupling one end of said receiver means to said outlet downstream of said furnace and sufficiently close to such outlet as to provide minimum unfired residence time of said effluent between said furnace outlet and said one end of said receiver means, said receiver means having therein a compression zone adjacent said one end of said receiver means, a mixing zone in communication with and downstream of said compression zone, a pressure recovery zone in communication with and downstream of said mixing zone, and a discharge opening in communication with and downstream of said pressure recovery zone; and means for introducing into said compression zone a quenching fluid at an elevated velocity relative to the velocity of the effluent discharged through said outlet from said furnace, the velocity and temperature of said quenching fluid being sufficient to entrain and quench said effluent in said compression zone, increase the pressure of said effluent in said pressure zone, discharge said effluent through said discharge opening, and reduce the pressure of said effluent gas in said furnace upstream from said outlet, thereby reducing the hydrocarbon residence time in said furnace.

2. The combination according to claim 1 wherein said quenching fluid comprises steam.

3. The combination according to claim 2 wherein said steam is at a pressure of between about 100 and 600 psig.

4. The combination according to claim 1 wherein said receiver means comprises a fluid ejector.

5. The combination according to claim 1 wherein said receiver means has a convergent section at said one end forming said compression zone, a substantially linear throat forming said mixing zone, and a divergent section forming said pressure recovery zone.

6. The combination according to claim 1 including second receiver means corresponding to the first-mentioned receiver means for receiving and further compressing and cooling effluent discharged from said first-mentioned receiver means.

7. The combination of a hydrocarbon cracking furnace and a furnace attachment for accelerating cracked gas effluent all of which is discharged from said furnace through an outlet, said attachment comprising effluent receiver means; means coupling one end of said receiver means to said outlet downstream of said furnace and sufficiently close to said outlet as to provide minimum unfired residence time of said effluent between the outlet of said furnace and said one end of said receiver means; and means for introducing into said one end of said receiver means a motive fluid at such velocity as to entrain and accelerate said effluent downstream of the outlet of said furnace, thereby reducing the residence time of hydrocarbon in said furnace.

* * * * *

UNITED STATES PATENT AND TRADEMARK OFFICE

CERTIFICATE OF CORRECTION

PATENT NO. : 5,324,486

DATED : June 28, 1994

INVENTOR(S) : Gaetano Russo

It is certified that error appears in the above-indentified patent and that said Letters Patent is hereby corrected as shown below:

Column 3, line 14, change "2Low" to

-- 2) Low --.

Signed and Sealed this

Twentieth Day of September, 1994

*Attest:*

*Attesting Officer*

BRUCE LEHMAN

*Commissioner of Patents and Trademarks*